United States Patent [19]

Siepermann et al.

[11] 4,395,944

[45] Aug. 2, 1983

[54] TWO ROLL PRESS

[75] Inventors: Walter Siepermann, Hattingen; Hans-Georg Bergendahl, Bochum, both of Fed. Rep. of Germany

[73] Assignee: Maschinefabrik Koppern GmbH & Co. K.G., Hattingen, Fed. Rep. of Germany

[21] Appl. No.: 313,120

[22] Filed: Oct. 20, 1981

[30] Foreign Application Priority Data

Oct. 22, 1980 [DE] Fed. Rep. of Germany ..... 3039743

[51] Int. Cl.[3] ..... B30B 3/00; B30B 3/04

[52] U.S. Cl. ..... 100/168; 100/176; 72/239; 308/DIG. 10

[58] Field of Search ..... 100/168, 47, 155, 176; 72/238, 239; 308/DIG. 10, 189

[56] References Cited

U.S. PATENT DOCUMENTS 3,306,090 2/1967 Dorp et al. ..... 72/239

3,635,066 1/1972 Schmiedberg ..... 72/239

3,899,965 8/1975 Koch et al. ..... 100/155 R 4,275,580 6/1981 Hayes ..... 72/239

*Primary Examiner*—Peter Feldman

*Attorney, Agent, or Firm*—Salter & Michaelson

[57] ABSTRACT

The invention relates to a two roll press having press rolls positioned side-by-side, the axes of which are mounted in bearing housings guided between parallel horizontal guiding surfaces in lateral frame members of the press frame, said guiding surfaces extending each to the ends of said frame members, and connecting frame heads provided in the area of the ends of said frame members, said connecting frame heads forming the abutments for the bearing housings and being detachably connected to said frame members, and being provided with means which enable them to be brought into a horizontal position in such way that one of the surfaces being in vertical position serves as guiding surface in vertical and lateral alignment with the guiding surface of the lower frame member.

7 Claims, 4 Drawing Figures

TWO ROLL PRESS

BACKGROUND OF THE INVENTION

Roll presses of this type are known from U.S. Pat. No. 3,899,965 to Koch et al.

When changing the rolls of roll presses having two rolls positioned side-by-side it is of importance to avoid canting of the rolls. Generally the bearing housings are not only guided in longitudinal direction of the frame member, but also in transverse direction thereto. For this purpose the bearing housings may overlap at least one shoulder of the guiding surfaces. Canting of the roll while removing it from or repositioning it into the press frame easily results in blocking and possibly damage of the guiding surfaces. Therefore when removing the rolls in the known manner by means of ropes there is to be proceeded with utmost caution. Neither other known devices operating with hydraulic cylinders ensure that the rolls will be actually moved without canting.

An even more difficult problem common to all known methods or devices is moreover the repositioning of the rolls into their working position within the frame.

Object of the invention is a device for moving the rolls out of and into the frame when changing them, said device being of simple construction and securing with great reliability a parallel guidance of the rolls during the movement.

SUMMARY OF THE INVENTION

According to the invention this problem is solved by a towing and pushing device having a frame member connectable to the end faces of said bearing housings of one roll each and on which a motor-actuated driving shaft is mounted in parallel relation to the axis of the roll after being connected to said bearing housings, at the end of said driving shaft being mounted toothed driving wheels cooperating with straight toothed members mounted in parallel relation to said guiding surfaces at the connecting frame heads.

Preferred embodiments of the invention are subject of the claims.

BRIEF DESCRIPTION OF THE DRAWINGS

By way of example the invention is now described in detail with reference to the accompanying drawings, in which:

FIG. 1(*b*) is a right side elevational view thereof;

DETAILED DESCRIPTION OF PREFERRED EMBODIMENTS

Figure 1A:
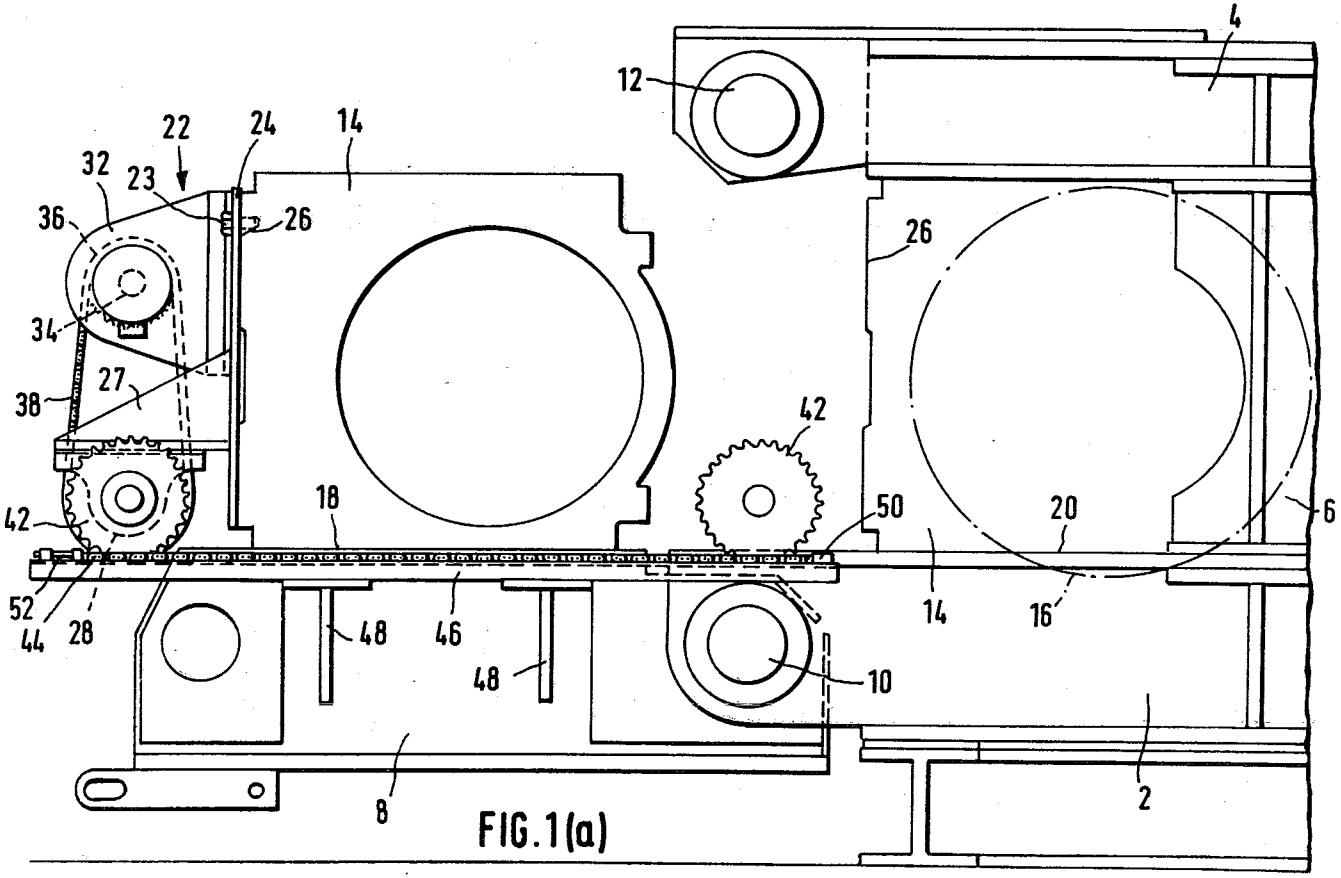
FIG. 1(*a*) is a left side elevational view of a two roll press.

The roll press shown by the drawing is of known construction having a frame with a lower frame member 2 and an upper frame member 4. The upper side of the lower frame member and the lower side of the upper frame member are formed to serve as guiding surfaces each over their whole length. The lower frame member 2 and the upper frame member 4 are connected to each other by a spacer 6. As connection is preferably provided a bolt connection. The ends of the upper and lower frame members are connected to each other by a connecting frame head 8, which is shown in the drawing in horizontal position, but is positioned vertically during normal operation and is connected to the upper and lower frame member each by a lower cross bolt 10 and an upper cross bolt 12.

Figure 1B:
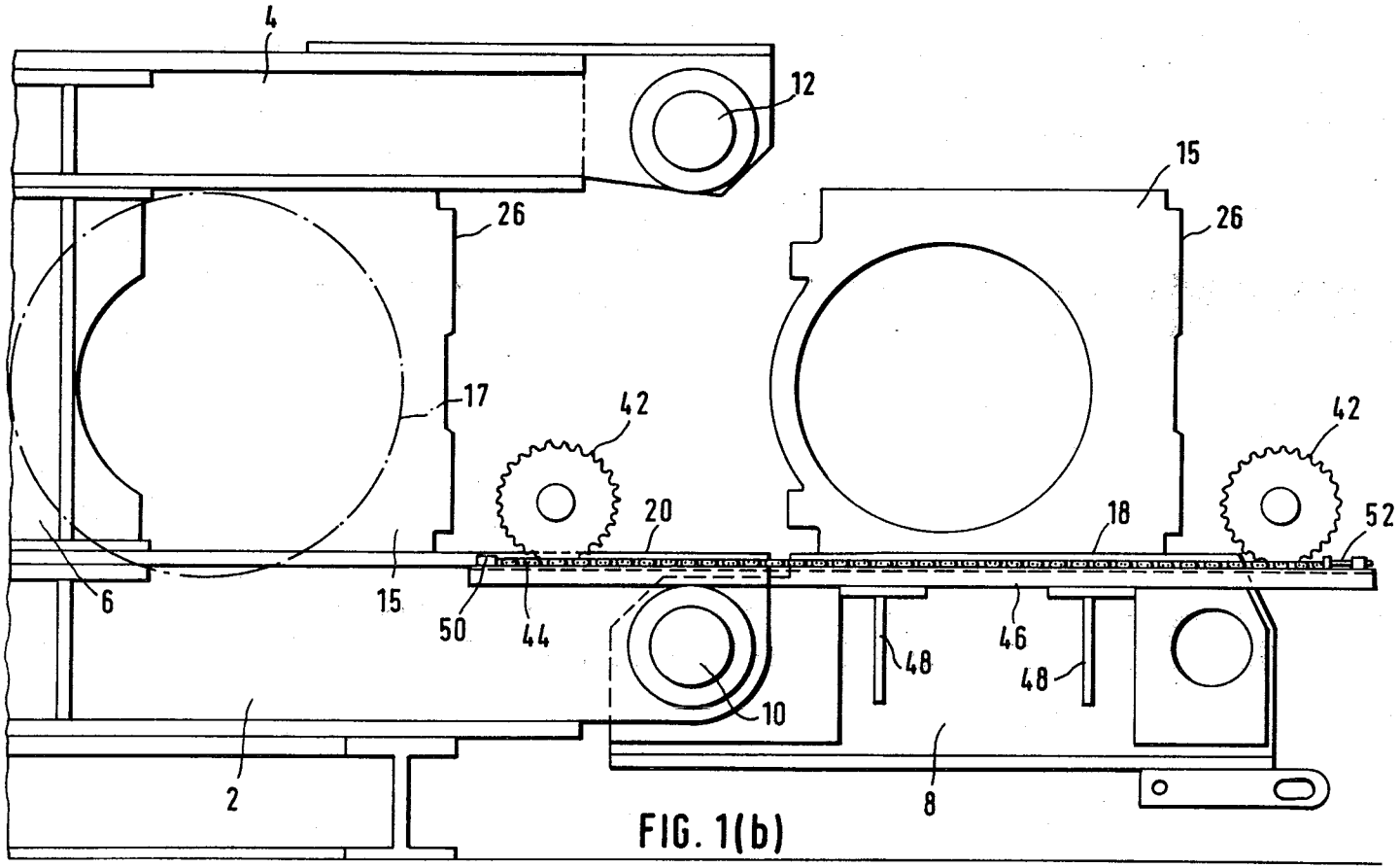

Between the upper and lower frame member are provided bearing housings 14 and 15 at both sides between the guiding surfaces, and in said bearing housings being rotatably mounted the rolls 16, 17. The bearing housings are displacable in longitudinal direction sliding on the guiding surface of the lower frame member 2. Said bearing housings are preferably further guided in transverse direction, e.g. by lateral shoulders 13. The connecting frame heads are used as abutment for the bearing housings 14 and 15, whereby the bearing housing 14 directly rests against the connecting frame head 8 on the left side in FIG. 1, while on the right side in FIG. 1 is provided a hydraulic support between the connecting frame head and the right bearing housing 15, said support being not shown in the drawing, resting also against the connecting frame head 8 and having a hydraulic piston. The bearing housing 15 rests against said hydraulic piston.

Details of the mounting of the rolls 16 and 17 in the bearing housings 14 and 15 are not shown in the drawings, since this is done in the usual way. The rolls 16 and 17 themselves are only indicated by dash-and-dot circles.

At least at their upper end the connecting frame heads are detachable from the upper frame member 4 by removing the cross bolt 12. In the lower region the connection between the connecting frame head 8 and the lower frame member 2 can be provided in such way that the connecting frame head 8 is pivotable about the lower cross bolt 10 into the horizontal position. The drawing shows this position of the two connecting frame heads 8 at both ends of the frame members 2 and 4. It is also possible to detach the connecting frame head at the lower end, too, and to provide means between the connecting frame head and the lower frame member which allow the connecting frame heads to be connected to the lower frame member after being tilted into the horizontal position. In the horizontal position of the connecting frame heads the surface 18 being then on top forms a guiding surface which is in alignment with the guiding surface 20 on the upper side of the lower frame member 2, and that both vertically as well as laterally the surface 18 is preferably the inner side of the connecting frame head in its effective working position. The rolls thus can be removed from the press frame with their bearing housings 14 sliding first on the surface 20 of the lower frame member and the surface 18 of the connecting frame head 8, and that until it lies exposed in front of the roll frame on the connecting frame heads 8. In this position there is free access to the roller, so that it can then be lifted by a crane, a fork lifter or a similar device.

Figure 2:
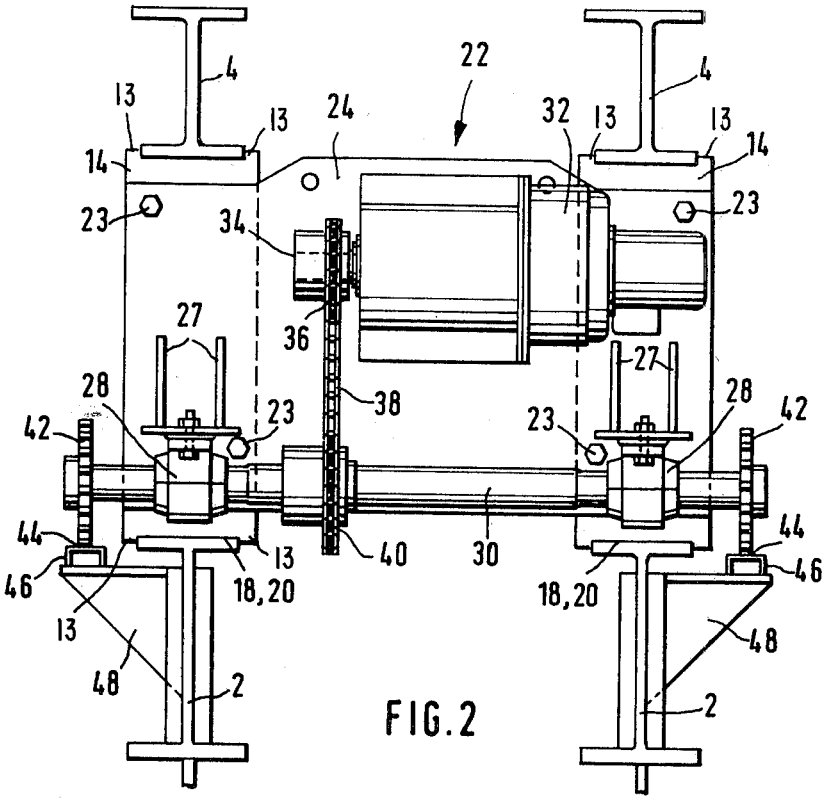
FIG. 2 is an end elevational view thereof.

In order to move the rolls, i.e. during removal from the frame and repositioning into the frame, a towing and pushing device 22 is provided as shown on the left side of FIG. 1 and in FIG. 2. This towing and pushing device comprises a basic frame element, in this case a plate 24, which is connectable to the bearing housings, preferably by bolting it to the end faces 26 of the bearing housings 14 and 15 respectively by means of bolts 23. On the plate 24 a driving shaft 30 is rotatably mounted in bearings 28 mounted on brackets 27 fixed to said plate. Above the driving shaft 30 a geared motor is mounted on the connecting plate 24, and that in such way that its output shaft 34 is in parallel relation to the axis of the driving shaft 30, which in turn is in parallel relation to the rotational axis of the roll in the bearing housing 14. On the output shaft 34 of the geared motor a roller-chain sprocket wheel is mounted which acts via a roller chain 38 onto a roller-chain sprocket wheel 40 mounted on the driving shaft 30.

At each of the free ends of the driving shaft 30 outside of the bearings 28 roller-chain sprocket wheels 42 are mounted, which cooperate with roller chains 44 mounted on supports 46, which are mounted on brackets 48 at the outside of the connecting frame heads 8. The supports 46 and the roller chains 44 thereon extend in vertical and longitudinal direction in parallel relation to the guiding surfaces 18, 20 on the lower frame member 2 and the connecting frame head 8 respectively.

Preferably the geared motor 32 is an electric motor provided with a loose connection lead and e.g. being supplied with current from a plug box. The geared motor can also be a pneumatic motor.

For changing the rolls the connecting frame heads 8 are brought into a horizontal position in which the surface 18 usually resting against the bearing housing 14 is in alignment with the guiding surface 20 of the lower frame member. Thereafter the towing and pushing device 22 is bolted with its connecting plate 24 to the bearing housings of one roll. Thereby the teeth of the sprocket wheel engage with the roller chains 44. Following thereto the geared motor is switched on with corresponding rotational direction. Via the roller-chain sprocket wheels 42 engaging with the roller chains 44 at the connecting frame heads 8 the roll is drawn out of the press frame with its two bearing housings 14 moving synchronously. After reaching the final position on the connecting frame head shown in FIG. 1 on the left, the connecting plate 24 of the towing and pushing device is detached from the bearing housings and removed. The roll can then be lifted by a hoisting device and a fresh roll can be deposited on the connecting frame heads with its bearing housings resting on the surface 18.

Then the towing and pushing device 22 is reconnected to the bearing housings 14 with its connecting plate 24. After the geared motor has been switched on with opposed rotational direction this roll is pushed into the frame with its two bearing housings moving in safe synchronism. After removal of the towing and pushing device the connecting frame heads are brought back into their upright position.

The towing and pushing devices 22 are represented in FIG. 1 for the positions of the bearing housings within the press frame and the position of the bearing housings 15 on the connecting frame heads 8 outside the frame on the right end of the press frame by showing only the roller chain sprocket wheels 42.

Figure 3:
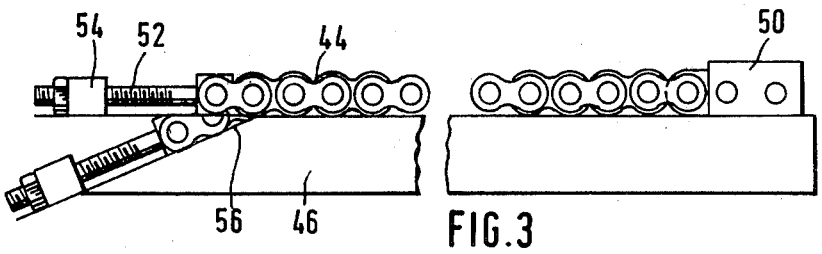
FIG. 3 is an enlarged view of the mounting of the roller chain as toothing element.

The mounting of the roller chains on the supports 46 is shown as enlarged view in FIG. 3. One end of the roller chain 44 is connected to the support 46 by means of a usual anchor plate 50, while at the opposite end of the support a tensioning bolt 52 with an anchor block 54 for the tensioning bolt is provided. In order to avoid overrunning of the final position especially when removing the rolls, the outer end of the roller chain can be lowered over a portion of length 56 as shown in FIG. 3 on the left side. The tensioning bolt 52 is then located at a corresponding angle to the surface 18. By this lowering of the end portions of the roller chains, the depth of which at least corresponds to the engaging depth of the teeth of the roller chain sprocket wheels, the roller-chain sprocket wheels disengage with the chain near the end of the movement during removal of the roll, so that the drive will become ineffective. In a corresponding way the opposite end of the roller chain 44 can also be lowered, in order to avoid an overload of the driving motor, when the bearing housing contacts the rigid stop at the spacer 6 during repositioning of the roll.

The supports 46 with the roller chains 44 are permanently secured to the connecting frame heads and remain there even during operation of the press. Thus only the towing and pushing device 22 which can be used for a number of presses requires a separate storing. As shown in FIG. 1 the support 46 extends over the end of the connecting frame head and thus overlaps the upper frame member 4 in the operating position of the connecting frame head. This can be tolerated. On the right side of FIG. 1 the way to be passed by the roll with its bearing housings within the frame is longer than on the left side and that by the width of the hydraulic pressure device. Therefore the support 46 with the roller chain 44 is to be made to exceed the end of the connecting frame head 8 adjacent to the lower frame member. In the operating position of the connecting frame head that end of the support 46 extends down below the lower edge of the frame member 2. This can be also tolerated, as usually there will be sufficient space by the base member on which the press is normally set up.

Instead of roller-chain sprocket wheels as driving wheels can of course be provided normal gear wheels cooperating with a gear rack on the support 46. Even a mangle gear can be provided.

It will be obvious to those skilled in the art that various changes may be made without departing from the scope of the invention and the invention is not to be considered limited to what is shown in the drawings and described in the specification.

What we claim as our invention and desire to secure by Letters Patent of the United States is:

1. A two roll press having press rolls positioned side-by-side, the axes of which are mounted in bearing housings guided between parallel horizontal guiding surface in lateral frame members of the press frame, said guiding surfaces extending each to the ends of said frame members, and connecting frame heads provided in the area of the ends of said frame members, said connecting frame heads forming the abutments for the bearing housings and being detachably connected to said frame members, and being provided with means which enable them to be brought into a horizontal position in such way that one of the surfaces being in vertical position serves as guiding surface in vertical and lateral alignment with the guiding surface of the lower frame member, characterized by a plurality of straight toothed members mounted on said connecting frame heads in substantially parallel relation to said guiding surfaces, and a towing and pushing device comprising a frame member connectable to the end faces of the housings of one of said rolls, a motor actuated driving shaft mounted on said frame so that it is substantially parallel to the axis of said one roll when said frame member is connected to said bearing housing thereof, and a plurality of toothed driving wheels mounted on said driving shaft in cooperative engagement with said straight toothed members.

2. A two roll press according to claim 1, characterized in that a geared motor is provided as drive at the towing and pushing device.

3. A two roll press according to claim 2, characterized in that the output shaft of the geared motor is in parallel relation to the driving shaft and connected to the driving shaft by a roller chain connection.

4. In the two roll press of claim 1, said straight toothed members comprising roller chains mounted on supports on said connecting frame heads, said driving wheels comprising chain sprocket wheels.

5. In the two roll press of claim 4, the end portion of each of said roller chains being inclined downwardly adjacent the end of the respective connecting frame head by an amount at least equal to the engaging depth of the teeth of the respective sprocket wheel.

6. A two roll press according to claim 4, characterized in that the supports on which the roller chains are mounted are provided at the outer opposite sides of the connecting frame heads.

7. A two roll press according to claim 6, characterized in that the supports are permanently secured on the connecting frame heads.

* * * * *